US005560136A

United States Patent [19]

Cupp

[11] Patent Number: 5,560,136

[45] Date of Patent: * Oct. 1, 1996

[54] PISTOL GRIP

[75] Inventor: Carl J. Cupp, Hawaiian Gardens, Calif.

[73] Assignee: Pachmayr Ltd., Monrovia, Calif.

[ * ] Notice: The portion of the term of this patent subsequent to Oct. 27, 2014, has been disclaimed.

[21] Appl. No.: 401,241

[22] Filed: Mar. 9, 1995

[51] Int. Cl.[6] ..... F41C 23/10

[52] U.S. Cl. ..... 42/71.02

[58] Field of Search ..... 42/71.01, 71.02; D22/108, 111

[56] References Cited

U.S. PATENT DOCUMENTS

| | | | |
|---|---|---|---|
| 809,080 | 1/1906 | Wight | 42/71.01 |
| 1,229,721 | 6/1917 | Cooke | 42/71.01 |
| 2,104,129 | 1/1938 | Kress | 42/71.01 |
| 2,308,627 | 1/1943 | Rickenbacher | 42/71.02 |
| 3,672,084 | 6/1972 | Pachmayr | 42/71.02 |
| 3,815,270 | 6/1974 | Pachmayr | 42/71.02 |
| 4,043,066 | 8/1977 | Pachmayr et al. | 42/71.02 |
| 4,132,024 | 1/1979 | Pachmayr et al. | 42/71.02 |
| 4,286,401 | 9/1981 | Pachmayr et al. | 42/71.02 |
| 4,359,833 | 11/1982 | Pachmayr et al. | 42/71.02 |
| 4,378,651 | 4/1983 | Pachmayr et al. | 42/71.02 |
| 4,658,528 | 4/1987 | Ruger | 42/71.02 |
| 4,771,562 | 9/1988 | Ruger | 42/71.02 |
| 5,231,237 | 7/1993 | Cupp | 42/71.02 |
| 5,465,520 | 11/1995 | Cupp | 42/71.02 |

*Primary Examiner*—Stephen C. Bentley
*Attorney, Agent, or Firm*—William P. Green

[57] ABSTRACT

A grip assembly for a gun having a downwardly projecting handle, which assembly includes two body panels to be received at opposite sides of the handle, and a grip unit having two side panels at outer sides of the body panels and a forward portion connecting the grip panels in front of the handle. The grip panels are preferably connected to the body panels by two screws and nuts. A third screw extends through an opening in one of the body panels, to hold it in place, and is desirably at a location to be covered by the corresponding grip panel. The third screw may be engageable with a third nut which is carried by the other body panel and is at a location to be covered by the other grip panel.

14 Claims, 3 Drawing Sheets

PISTOL GRIP

This invention relates to improved grips to be attached to the handle of a gun, for enhancing the comfort of the contact between the grip and a user's hand, and for improving the user's control over the gun.

BACKGROUND OF THE INVENTION

The grips of the present invention are of a type similar in some respects to the grips shown in U.S. Pat. No. 5,231,237 issued Jul. 27, 1993 to Carl J. Cupp on "Gun Grip Assembly". The grips disclosed in that patent include two body panels which are received at opposite sides of the handle of a gun, and two grip panels received and retained at outer sides of the body panels. The grip panels are preferably formed at least in part of elastomeric material to cushion the contact of a user's hand with the grip assembly, while the body panels may be made of a more rigid material. The grip panels may be portions of a grip unit having a connecting portion extending between and interconnecting the grip panels, desirably in front of the gun handle, with screws extending through openings in the grip panels and connected threadedly to the more rigid body panels to retain the grip unit in place.

SUMMARY OF THE INVENTION

An object of the present invention is to provide improvements in the manner of attachment of the body panels of a grip assembly of the above discussed general type to the handle of a gun. In U.S. Pat. No. 5,231,237, the body panels are attached to the gun handle by a pin extending through lower rear portions of the panels, and by an interfitting relationship between the panels and the gun handle. In the present arrangement, the body panels may be attached by extension of a threaded screw or screws through an opening or openings formed in at least one of the panels. The invention is particularly concerned with the positioning of that opening and the screw in a manner hiding the screw from view when the grip assembly is in position on the gun handle. In particular, the screw is so located that it and the opening in one of the body panels through which the screw extends are covered by a corresponding one of the side panels of the elastomeric grip unit when that grip unit is attached to the body panels.

Preferably, the body panels contain recesses in their outer surfaces within which the side panels of the grip unit are received in the assembled condition of the parts, and the opening through which the mentioned screw extends in attaching the body panel to the gun handle is formed within that recess, to thereby be covered by the grip panel. The screw may extend through an opening in the gun handle to connect at its end with a nut carried by or associated with the body panel at the opposite side of the handle.

BRIEF DESCRIPTION OF THE DRAWINGS

The above and other features and objects of the invention will be better understood from the following detailed description of the typical embodiment illustrated in the accompanying drawings, in which.

DESCRIPTION OF THE PREFERRED EMBODIMENTS

Figure 1:
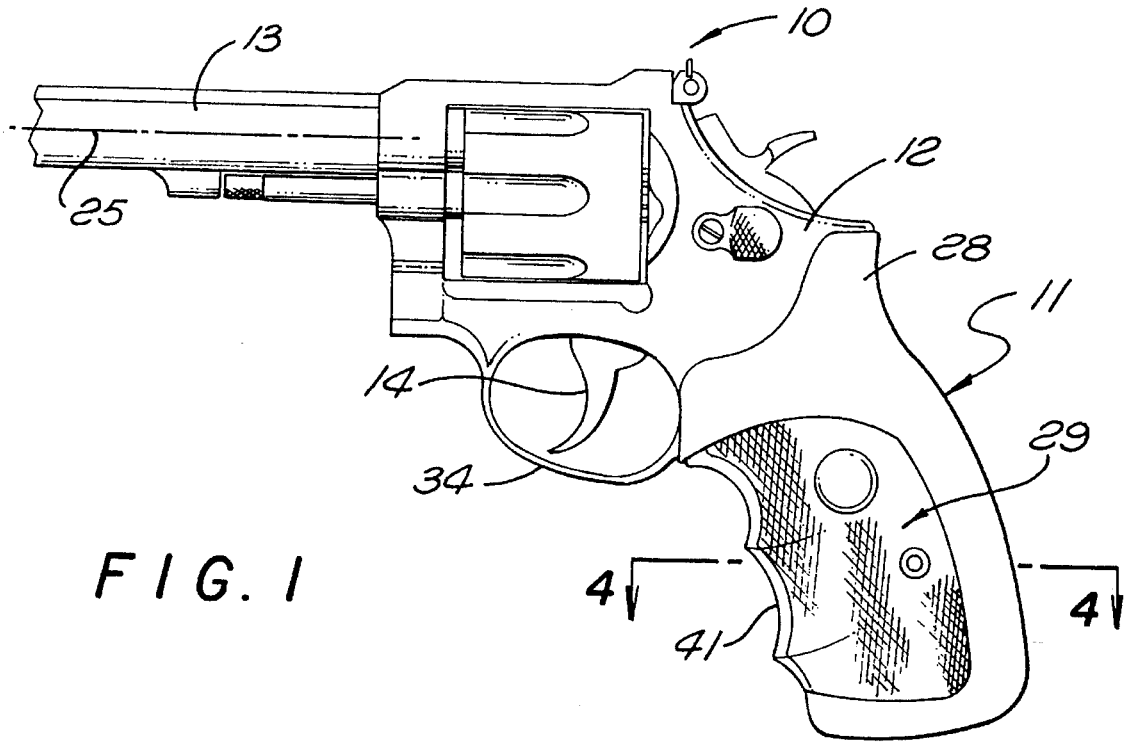
FIG. 1 is a fragmentary side elevational view of a revolver having a grip assembly embodying the invention.

FIG. 1 shows a revolver 10 having a grip assembly 11 formed in accordance with the present invention. The gun has a main frame 12 with a forwardly projecting barrel 13 and with the usual trigger 14 for controlling firing of the gun. A downwardly projecting portion 15 of the frame forms the handle of the gun to which grip assembly 11 is attached.

Figure 3:
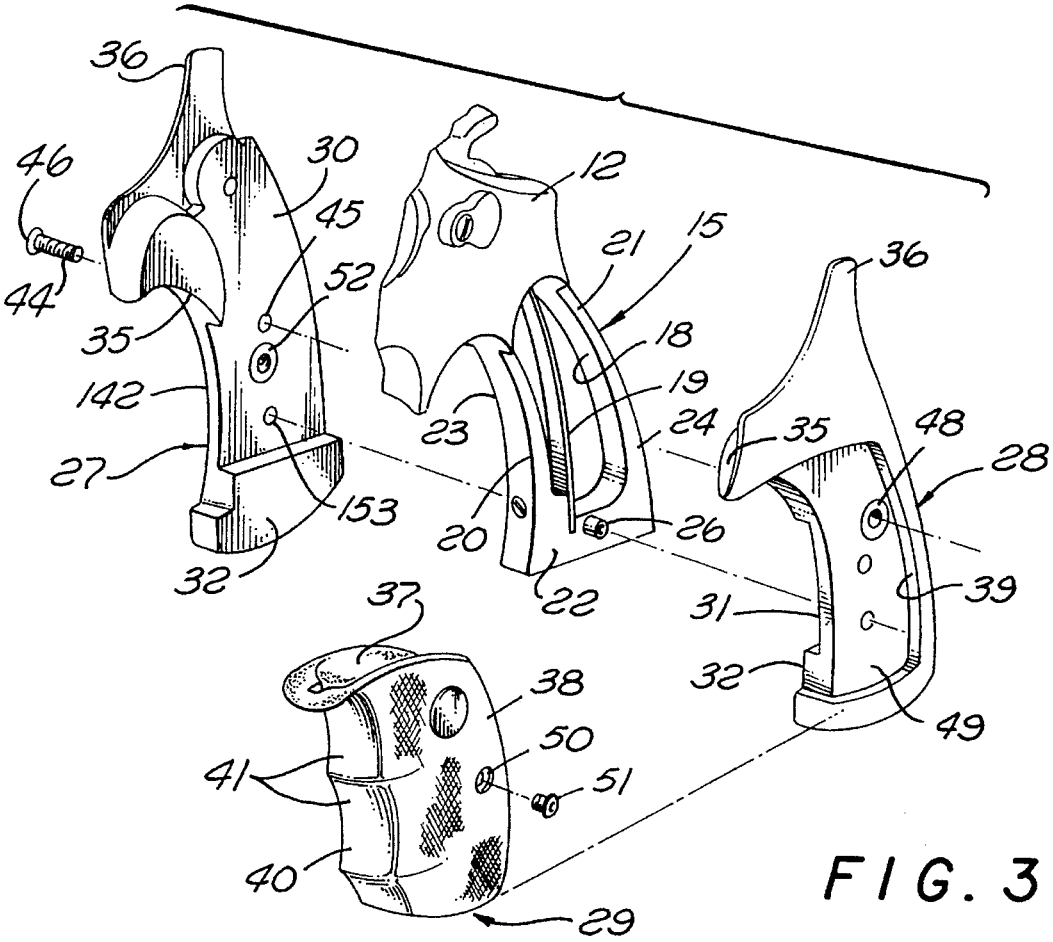
FIG. 3 is an exploded perspective view of the different parts of the grip and the gun handle.
Figure 5:
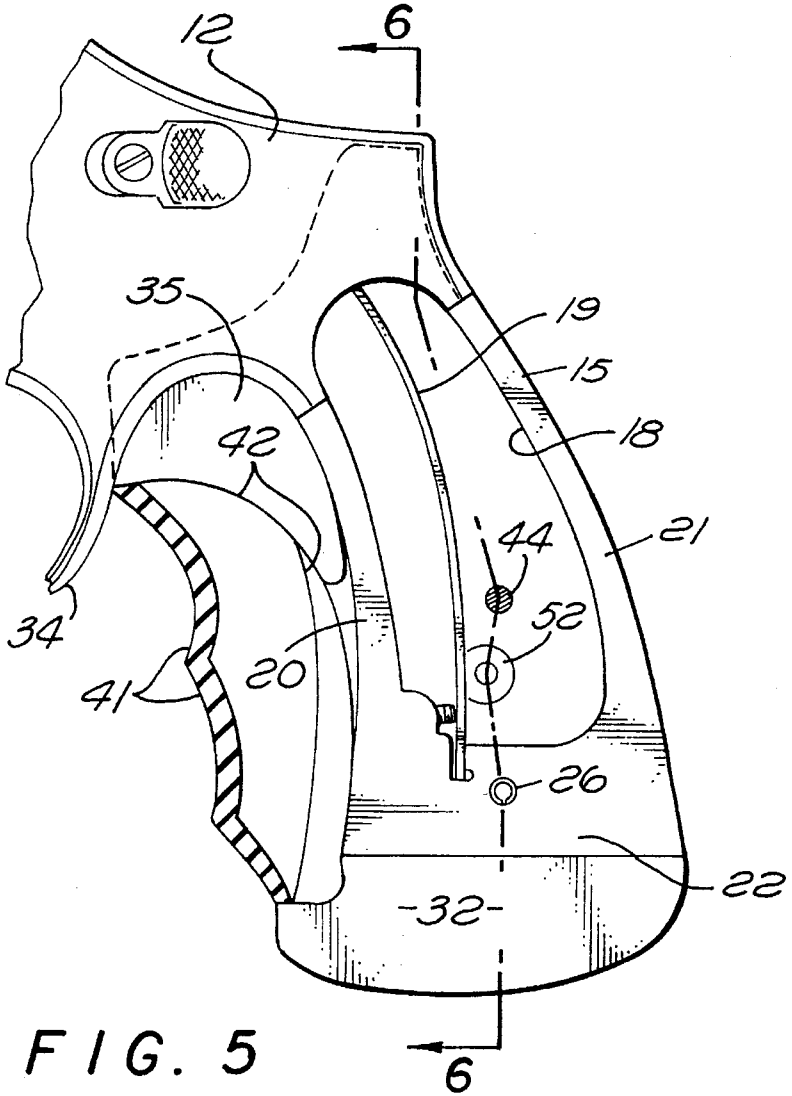
FIG. 5 is a reduced scale vertical section taken on line 5—5 of FIG. 4.

As seen in FIGS. 3 and 5, the handle 15 of the gun contains a vertically elongated hole or opening 18 extending through the entire transverse thickness of the handle, and within which a main spring 19 of the gun is received. Portions 20 and 21 of the handle extend downwardly in front of and behind opening 18, and are interconnected at the lower end of the gun by a connecting portion 22 of the handle. At their opposite sides, portions 20, 21 and 22 of the handle have parallel planar opposite side surfaces 23 and 24 lying in planes disposed parallel to and at opposite sides of the axis 25 of the barrel. A pin 26 extends transversely through the lower portion 22 of the gun handle, perpendicular to surfaces 23 and 24, and projects beyond those surfaces at both sides, of the handle for engagement with the grip assembly in locating relation.

Grip assembly 11 includes two body panels 27 and 28 received at opposite sides of handle 15 of the gun, and a grip unit 29 attached to body panels 27 and 28 and extending across the front of the gun handle. Grip unit 29 is molded of resiliently deformable elastomeric material, preferably neoprene, and the body panels 27 and 28 are desirably formed of a material harder than the elastomeric material of unit 29. In the preferred arrangement, body panels 27 and 28 are rigid, and may be formed of wood.

Figure 4:
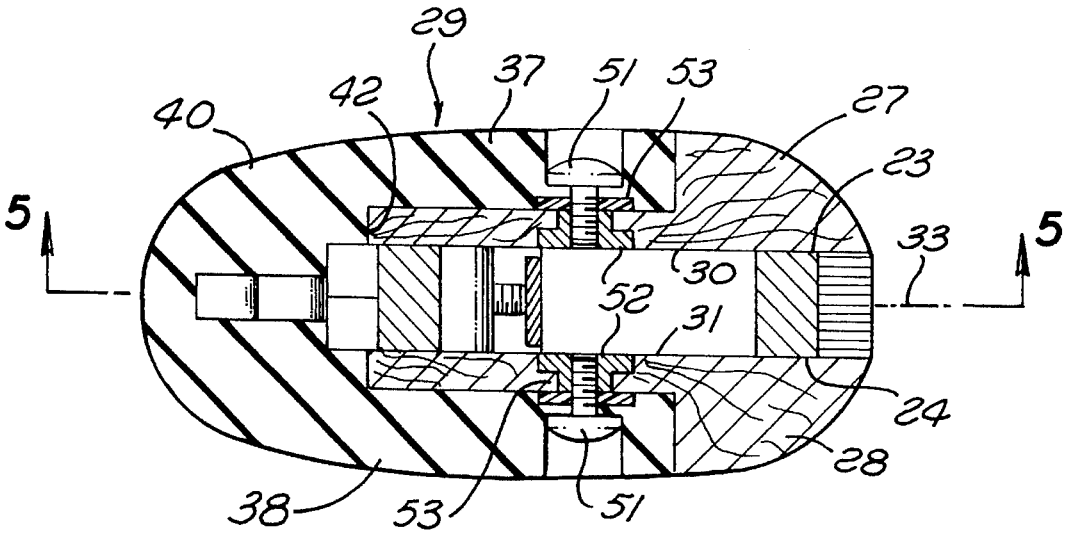
FIG. 4 is an enlarged horizontal section taken on line 4—4 of FIG. 1.
Figure 6:
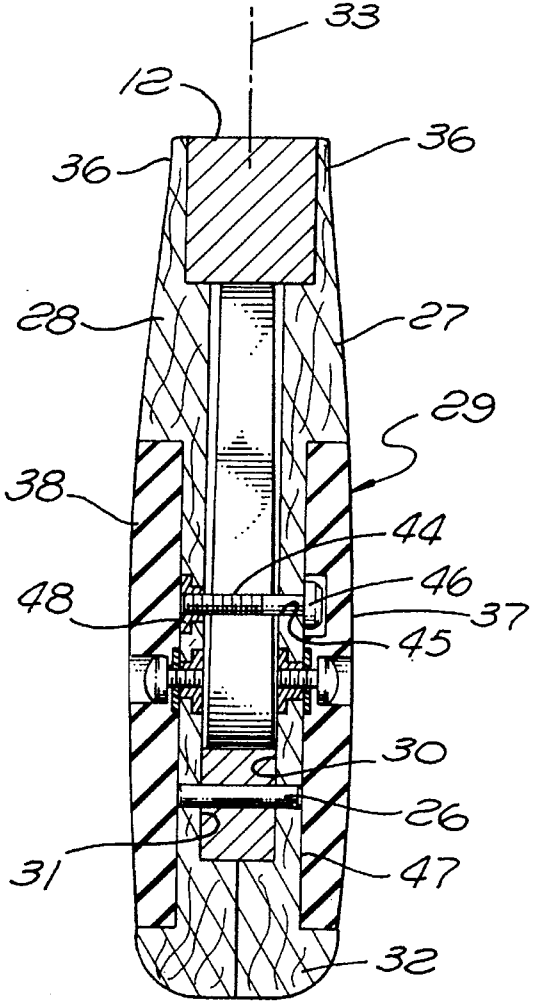
FIG. 6 is a generally vertical section taken on line 6—6 of FIG. 5.

The body panels 27 and 28 have inner parallel vertical planar surfaces 30 and 31 (FIG. 4) which engage the outer surfaces 23 and 24 of portions 20, 21 and 22 of the gun handle. At their lower ends, the body panels 27 and 28 have portions 32 which extend toward one another at the underside of bottom portion 22 of the gun handle, and meet in a central vertical plane 33. Behind the trigger guard 34, the body panels have portions 35 which project toward one another and meet in the central plane 33 and are shaped to fit within the recess formed between the trigger guard and front portion 20 of the gun handle. At their upper ends, the inner surfaces of the body panels 27 and 28 are notched away to fit the frame at the upper end of the handle and have reduced thickness portions 36 engaging the opposite sides of the frame at that location.

Figure 2:
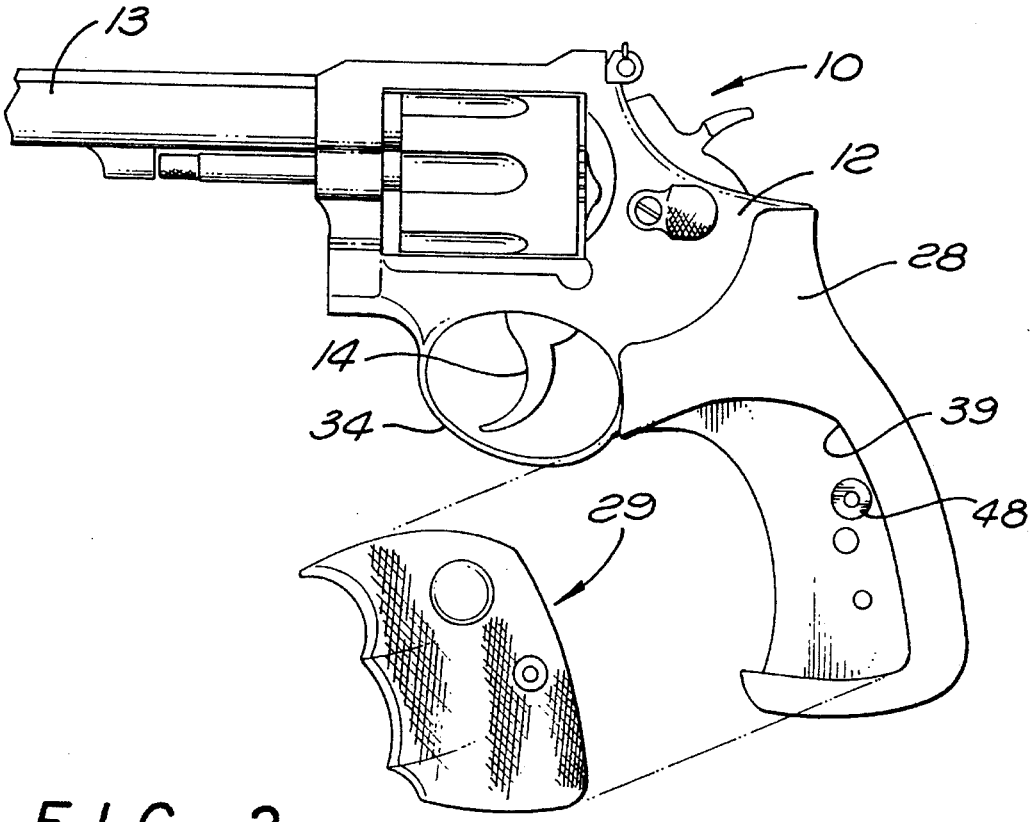
FIG. 2 is a view similar to FIG. 1 but with the elastomeric grip unit detached from the gun.

Elastomeric grip unit 29 is shaped to form two opposite side grip panels 37 and 38 received at the outer sides of the two body panels 27 and 28 respectively and having the outline configuration illustrated in FIGS. 1 and 2. These grip panels 37 and 38 are received within recesses 39 formed in the outer surfaces of the two body panels 27 and 28, which recesses have the same outline configuration as grip panels 37 and 38 to receive those grip panels in closely fitting relation. In addition to the panels 37 and 38 at opposite sides of the gun handle, grip unit 29 has a forward portion 40 which is molded integrally with side panels 37 and 38, of the same elastomeric material, and extends between and interconnects those side panels in front of the gun handle. At its forward side, the connector portion 40 of grip unit 29 has finger recesses or grooves 41 to be gripped by a user's hand in holding and firing the gun. At the back of connector portion 40 of the grip unit, that portion has curving surfaces 42 shaped to follow the curving contour of the forward edges 142 of body panels 27 and 28.

The two body panels 27 and 28 are retained tightly against the opposite sides of gun handle 15 by a threaded screw 44 which extends through a circular opening 45 formed in panel 27, and which has an enlarged head 46 larger than opening 45 and engaging the surface 47 of panel 27 to pull that panel tightly against the gun handle. At its opposite end, the threaded shank of screw 44 engages a nut 48 carried at the outer side of the second body panel 28, within a shallow recess in surface 49 of that body panel, so that tightening of the screw pulls panel 28 against the opposite side of the gun handle. Opening 45 in panel 27 and the opening within panel 28 within which nut 48 is received are both located within the recesses 39 formed in the outer surfaces of the body panels 27 and 28, so that these openings and the opposite ends of screw 44 and the nut are all covered by the side panels 37 and 38 of grip unit 29 when that grip unit is in its FIG. 1 assembled position of attachment to panels 27 and 28.

Each of the grip panels contains an opening 50 through which a threaded screw 51, extends for threaded attachment to a nut 52 carried within a recess at the inner-side of the corresponding body panel 27 or 28, to attach the grip unit to panels 27 and 28. Rigid annular washers 53 of stiff resinous plastic material, metal, or other material are embedded within and bonded to the elastomeric material of the side panels 37 and 38 of grip unit 29, to reinforce the elastomeric material of the grip unit at those locations and take the force applied by the heads of screws 51 when those screws are tightened to hold panels 37 and 38 against panels 27 and 28. Beneath the locations of screws 44 and 51, the inner surfaces of body panels 27 and 28 may contain transverse openings or recesses 153 within which the opposite ends of pin 26 are received to further locate the parts relative to the gun handle. The main connecting screw 44 is of course offset from main spring 19 of the gun to avoid interference with the functioning of the gun.

In assembling the grip of the present invention on handle 15 of the gun, a person first places the two rigid side panels 27 and 28 against opposite sides of the handle, and then inserts screw 44 through opening 45 in panel 27 and then through the opening 18 in the handle for connection with nut 48 carried by panel 28. The screw is tightened, by reception of an allen wrench within a drive recess in the head of screw 44, to draw panels 27 and 28 tightly against opposite sides of the gun handle. Grip unit 29 is then brought into engagement with the forward edges of panels 27 and 28, so that the side panels 37 and 38 of the grip unit can be moved into recesses 39 of panels 27 and 28, and retained therein by connection of screws 51 with nuts 52 of panels 27 and 28. After such assembly, the head of screw 44 and the nut 28 engaged by that screw are both hidden from view by side panels 37 and 38 of the grip unit. In firing the gun, the engagement of a user's hand with the outer surfaces of side panels 37 and 38 of the grip unit and the forward surfaces of connector portion 40 of that unit provides sufficient friction with the hand to enable effective control and manipulation of the gun, and in addition cushions the contact between the hand and the grip. The exposure of some portions of the outer surfaces of rigid body panels 27 and 28, about recesses 39 and at the rear of the gun, allows the hand of a user to slide relative to the grip at those locations, as is desirable in some gun handling situations, as for instance when the gun is being drawn rapidly from a holster.

While a certain specific embodiment of the present invention has been disclosed as typical, the invention is not limited to this particular form, but rather is applicable broadly to all such variations as fall within the scope of the appended claims.

I claim:

1. A grip assembly for a gun having a downwardly projecting handle, comprising:

two essentially rigid body panels to be received at opposite sides of the handle;

a unit molded of resiliently deformable elastomeric material and having two grip panels to be received and retained at outer sides of said two body panels respectively, and having a connecting portion molded integrally with said grip panels to be received in front of the handle and extending between and interconnecting said grip panels;

each of said body panels containing a recess at its outer side for receiving the corresponding grip panel and shaped in correspondence therewith;

one of said body panels containing an opening within said recess therein;

a first screw adapted to extend through said opening and retain said one body panel against the handle;

one of said grip panels being shaped and positioned to cover said opening and prevent access to said screw extending through said opening when said one grip panel is in said recess in said one body panel;

a nut carried by the other of said body panels within said recess therein and adapted to be threadedly engaged by said fastener to tighten both body panels against the gun handle;

two additional nuts carried by said body panels respectively at the locations of said recesses; and two additional screws adapted to extend through openings in said grip panels and connect threadedly to said additional nuts to detachably secure the grip panels to the body panels.

2. A grip assembly for a gun having a downwardly projecting handle, comprising:

two body panels to be received at opposite sides of the handle;

a grip unit including two side grip panels to be received and retained at outer sides of said two body panels respectively, and having a connecting portion extending between said grip panels in front of the gun handle and interconnecting said grip panels;

two nuts associated with said two body panels respectively; and two screws adapted to extend through openings in said grip panels respectively and connect detachably to said nuts to removably retain the grip panels at the outer sides of the body panels;

one of said body panels containing an opening through which a third screw is to extend for removably retaining said one body panel against a side of said handle;

one of said grip panels being shaped and positioned to cover said one body panel at the location of said opening and prevent access to said third screw when said one grip panel is retained at the outer side of said one body panel by a corresponding one of said two screws.

3. A grip assembly as recited in claim 2, including a third nut carried by the other of said body panels to be threadedly engaged by said third screw in a relation enabling both of said body panels to be retained against the handle by tightening of said third screw relative to said third nut.

4. A grip assembly as recited in claim 3, in which the other of said grip panels is shaped and positioned to cover said other body panel at the location of said third nut.

5. A grip assembly as recited in claim 2, in which said body panels contain recesses at their outer sides for receiving said grip panels and shaped essentially in correspondence therewith, said opening in said one body panel extending through said one body panel at the location of said recess therein.

6. A grip assembly as recited in claim 7, in which said body panels contain recesses at their outer sides for receiving said grip panels and shaped essentially in correspondence therewith, said opening in said one body panel extending through said one body panel at the location of said recess therein, and said third nut being carried by said other body panel at the location of said recess therein.

7. A grip assembly as recited in claim 6, in which said grip panels and said connecting portion of said unit are formed at least in part of elastomeric material, and said body panels are more rigid than said elastomeric material.

8. A grip assembly as recited in claim 2, in which said grip panels and said connecting portion of said unit are formed at least in part of elastomeric material, and said body panels are more rigid than said elastomeric material.

9. A grip assembly as recited in claim 8, including elements embedded in said elastomeric material of the grip panels and formed of material more rigid than said elastomeric material and against which force is applied by said two screws to secure the grip panels to the body panels.

10. A grip assembly for a gun having a downwardly projecting handle, comprising:

two body panels to be received at opposite sides of the handle;

a grip unit including two side grip panels to be received and retained at outer sides of said two body panels respectively, and having a connecting portion extending between said grip panels in front of the gun handle and interconnecting said grip panels;

two nuts associated with said two body panels respectively;

two screws adapted to extend through openings in said grip panels respectively and connect detachably to said nuts to removably retain the grip panels at the outer sides of the body panels;

a third screw adapted to extend through an opening in one of said body panels and through said gun handle toward the other body panel; and a third nut for applying retaining force to the other body panel and which is threadedly engaged by said third screw in a relation tightening both body panels against the handle upon tightening of said third screw relative to the third nut.

11. A grip assembly as recited in claim 10, in which said body panels contain recesses at their outer sides for receiving said grip panels and shaped essentially in correspondence therewith.

12. A grip assembly as recited in claim 11, in which said grip panels and said connecting portion of said unit are formed at least in part of elastomeric material, and said body panels are more rigid than said elastomeric material.

13. A grip assembly as recited in claim 10, in which said grip panels and said connecting portion of said unit are formed at least in part of elastomeric material, and said body panels are more rigid than said elastomeric material.

14. A grip assembly for a gun having a downwardly projecting handle, comprising:

two body panels to be received at opposite sides of the handle;

a grip unit including two side grip panels to be received and retained at outer sides of said two body panels respectively, and having a connecting portion extending between said grip panels in front of the gun handle and interconnecting said grip panels;

two nuts associated with said two body panels respectively;

two threaded screws adapted to extend through openings in said grip panels respectively and connect detachably to said nuts to removably retain the grip panels at the outer sides of the body panels; and a third threaded screw adapted to extend through an opening in one of said body panels but not through a corresponding one of said grip panels and which tightens said one body panel against a side of the handle.

* * * * *